US009217291B2

(12) United States Patent
Batarseh

(10) Patent No.: US 9,217,291 B2
(45) Date of Patent: Dec. 22, 2015

(54) DOWNHOLE DEEP TUNNELING TOOL AND METHOD USING HIGH POWER LASER BEAM

(71) Applicant: Saudi Arabian Oil Company, Dhahran (SA)

(72) Inventor: Sameeh Issa Batarseh, Dhahran (SA)

(73) Assignee: SAUDI ARABIAN OIL COMPANY (SA)

( * ) Notice: Subject to any disclaimer, the term of this patent is extended or adjusted under 35 U.S.C. 154(b) by 382 days.

(21) Appl. No.: 13/914,250

(22) Filed: Jun. 10, 2013

(65) Prior Publication Data

US 2014/0360778 A1 Dec. 11, 2014

(51) Int. Cl.

| | |
|---|---|
| ***E21B 7/15*** | (2006.01) |
| ***E21B 7/14*** | (2006.01) |
| ***E21B 7/04*** | (2006.01) |

(52) U.S. Cl.

CPC . *E21B 7/15* (2013.01); *E21B 7/046* (2013.01); *E21B 7/14* (2013.01)

(58) Field of Classification Search

CPC ..... E21B 7/10; E21B 7/06; E21B 7/14; E21B 7/15; E21B 10/60; E21B 7/068; E21B 7/046; E21C 37/16; E21C 37/18

See application file for complete search history.

(56) References Cited

U.S. PATENT DOCUMENTS

| | | | | |
|---|---|---|---|---|
| 4,090,572 | A | 5/1978 | Welch | |
| 4,227,582 | A | 10/1980 | Price | |
| 4,282,940 | A | 8/1981 | Salisbury et al. | |
| 6,870,128 | B2 | 3/2005 | Kobayashi et al. | |
| 6,880,646 | B2 | 4/2005 | Batarseh | |
| 6,888,097 | B2 | 5/2005 | Batarseh | |
| 7,490,664 | B2 | 2/2009 | Skinner et al. | |
| 2006/0102343 | A1 * | 5/2006 | Skinner | E21B 7/15 166/250.1 |
| 2007/0267220 | A1 | 11/2007 | Magiawala et al. | |
| 2010/0044102 | A1 * | 2/2010 | Rinzler | E21B 7/14 175/15 |

(Continued)

FOREIGN PATENT DOCUMENTS

| | | | |
|---|---|---|---|
| GB | 2 420 135 | A | 5/2006 |
| WO | 2004/009958 | A1 | 1/2004 |

OTHER PUBLICATIONS

Batarseh et al. "Well Perforation Using High-Power Lasers" SPE Annual Technical Conference and Exhibition, SPE 84418, Denver, Colorado, Oct. 5-8, 2003, 10 pages.

(Continued)

*Primary Examiner* — Yong-Suk (Philip) Ro

(74) *Attorney, Agent, or Firm* — Bracewell & Giuliani LLP; Constance Gall Rhebergen

(57) ABSTRACT

A downhole laser tool for penetrating a hydrocarbon bearing formation includes a laser surface unit to generate a high power laser beam, a fiber optic cable to conduct the high power laser beam from the laser surface unit to a rotational system that has a rotational head which includes a focusing system and a downhole laser tool head, the focusing system includes a beam manipulator, a focused lens, and a collimator, the downhole laser tool head includes a first cover lens to protect the focusing system, a laser muzzle to discharge the collimated laser beam from the downhole laser tool head into the hydrocarbon bearing formation, a fluid knife to sweep the first cover lens, a purging nozzle to remove dust from the path of the collimated laser beam, a vacuum nozzle to collect dust and vapor from the path of the collimated laser beam.

15 Claims, 6 Drawing Sheets

(56) References Cited

U.S. PATENT DOCUMENTS

| | | | | |
|---|---|---|---|---|
| 2012/0074110 | A1* | 3/2012 | Zediker | B08B 7/0042 219/121.72 |
| 2012/0118568 | A1 | 5/2012 | Kleefisch et al. | |
| 2012/0267168 | A1* | 10/2012 | Grubb | B23K 26/0093 175/16 |
| 2013/0008659 | A1 | 1/2013 | Schultz et al. | |
| 2013/0228372 | A1* | 9/2013 | Linyaev | E21B 7/15 175/16 |

OTHER PUBLICATIONS

Anonymous "Laser Applications Laboratory—Laser Oil & Gas Well Drilling" Argonne National Laboratory, Nuclear Engineering Division, http://www.ne.anl.gov/facilities/lal/laser_drilling.html, printed Feb. 5, 2013, 2 pages.

Bakhtbidar et al. "Application of Laser Technology for Oil and Gas Wells Perforation" SPE/IADC Middle East Drilling Technology Conference and Exhibition, SPE/IADC 148570, Muscat, Oman, Oct. 24-26, 2011, 12 pages.

Batarseh et al. "Deep hole penetration of rock for oil production using Ytterbium fiber laser" SPIE Proceedings, Conference vol. 5448, High-Power Laser Ablation V, 818, Taos, New Mexico, Sep. 20, 2004, 9 pages.

Batarseh et al. "Innovation in Wellbore Perforation Using High-Power Laser" International Petroleum Technology Conference, IPTC 10981, Doha, Qatar, Nov. 21-23, 2005, 7 pages.

PCT International Search Report and the Written Opinion; dated Feb. 18, 2015; International Application No. PCT/US2014/036553; International File Date: May 2. 2014.

* cited by examiner

DOWNHOLE DEEP TUNNELING TOOL AND METHOD USING HIGH POWER LASER BEAM

FIELD OF THE INVENTION

This invention relates to a method and apparatus for penetrating a hydrocarbon bearing formation. More specifically, this invention relates to a method and apparatus for sublimating hydrocarbon bearing formations using a downhole laser tool for the purpose of building a network.

BACKGROUND OF THE INVENTION

Wellbore stimulation is a branch of petroleum engineering focused on ways to enhance the flow of hydrocarbons from a formation to the wellbore for production. To produce hydrocarbons from the targeted formation, the hydrocarbons in the formation need to flow from the formation to the wellbore in order to be produced and flow to the surface. The flow from the formation to the wellbore is carried out by the means of formation permeability. When formation permeability is low, stimulation is applied to enhance the flow. Stimulation can be applied around the wellbore and into the formation to build a network in the formation.

The first step for stimulation is commonly by perforating the casing and cementing in order to reach the formation. One way to perforate the casing is the use of a shaped charge. Shaped charges are lowered into the wellbore to the target release zone. The release of the shaped charge creates short tunnels that penetrate the steel casing, the cement and into the formation.

The use of shaped charges has several disadvantages. For example, shaped charges produce a compact zone around the tunnel, which reduces permeability and therefore production. The high velocity impact of a shaped charge crushes the rock formation and produces very fine particles that plug the pore throat of the formation reducing flow and production. There is the potential for melt to form in the tunnel. There is no control over the geometry and direction of the tunnels created by the shaped charges. There are limits on the penetration depth and diameter of the tunnels. There is a risk in involved while handling the explosives at the surface.

The second stage of stimulation typically involves pumping fluids through the tunnels created by the shaped charges. The fluids are pumped at rates exceeding the formation breaking pressure causing the formation and rocks to break and fracture, this is called hydraulic fracturing. Hydraulic fracturing is carried out mostly using water base fluids called hydraulic fracture fluid. The hydraulic fracture fluids can be damaging to the formation, specifically shale rocks. Hydraulic fracturing produces fractures in the formation, creating a networking between the formation and the wellbore.

Hydraulic fracturing also has several disadvantages. First, as noted above, hydraulic fracturing can be damaging to the formation. Additionally, there is no control over the direction of the fracture. Fractures have been known to close back. There are risks on the surface due to the high pressure of the water in the piping. In regions with water shortages, obtaining the millions of gallons of water required for hydraulic fracturing presents a challenge. There are environmental concerns regarding the components added to hydraulic fracturing fluids.

Additionally, the two-stage fracturing system as described above can be costly.

SUMMARY OF THE INVENTION

The present invention relates to a method and apparatus for penetrating a hydrocarbon bearing formation to a desired penetration depth. More specifically, the present invention relates to a downhole laser tool for use in penetrating hydrocarbon bearing formations.

In one embodiment of the present invention, the downhole laser tool for penetrating a hydrocarbon bearing formation includes a laser surface unit configured to generate a high power laser beam. The laser surface unit is in electrical communication with a fiber optic cable. The fiber optic cable is configured to conduct the high power laser beam. The fiber optic cable includes an insulation cable configured to resist high temperature and high pressure, a protective laser fiber cable configured to conduct the high power laser beam, a laser surface end configured to receive the high power laser beam, a laser cable end configured to emit a raw laser beam from the fiber optic cable. The downhole laser tool includes an outer casing placed within an existing wellbore, which extends within a hydrocarbon bearing formation, a hard case placed within the outer casing, wherein the fiber optic cable is contained within the hard case, and a rotational system positioned within the outer casing. The rotational system includes a rotational casing coupled to the end of the hard case and a rotational head extending from the rotational casing. The rotational system is configured to rotate around the axis of the hard case. The rotational head includes a focusing system configured to direct the raw laser beam and a downhole laser tool head configured to discharge a collimated laser beam into the hydrocarbon bearing formation. The focusing system includes a beam manipulator configured to direct the raw laser beam, a focused lens configured to create a focused laser beam, and a collimator configured to create the collimated laser beam. The beam manipulator is positioned proximate to the laser cable end of the fiber optic cable, the focused lens is positioned to receive the raw laser beam, the collimator is positioned to receive the focused laser beam. The downhole laser tool head includes a first cover lens proximate to the focusing system, a laser muzzle positioned to discharge the collimated laser beam from the downhole laser tool head, a fluid knife proximate to the laser muzzle side of the first cover lens, a purging nozzle within the downhole laser tool proximate to the laser muzzle, a vacuum nozzle proximate with the laser muzzle, and a temperature sensor adjacent to the laser muzzle. The first cover lens is configured to protect the focusing system. The fluid knife is configured to sweep the first cover lens. The purging nozzle is configured to remove dust from the path of the collimated laser beam. The vacuum nozzle is configured to collect vapor from the path of the collimated laser beam.

In certain embodiments, the downhole laser tool includes stabilizing pads attached to the hard case and configured to hold the hard case in place relative to the outer casing.

In certain embodiments of the downhole laser tool, the beam manipulator is a reflector mirror.

In certain embodiments of the downhole laser tool the beam manipulator is a beam splitter.

In certain embodiments, the downhole laser tool further includes a second cover lens positioned proximate to the first cover lens between the first cover lens and the fluid knife.

In certain embodiments of the downhole laser tool the focused lens is positioned proximate to the laser cable end of the fiber optic cable, the collimator is positioned to receive the focused laser beam, the beam manipulator is positioned to receive the collimated laser beam.

In certain embodiments, the downhole laser tool further includes multiple rotational heads extending from one rotational casing.

In certain embodiments, the downhole laser tool further includes multiple rotational systems.

In certain embodiments, the downhole laser tool head has a tapered laser muzzle.

The present invention is also directed to a method for penetrating a hydrocarbon bearing formation with a downhole laser tool. The method includes extending a downhole laser tool into an existing wellbore. The downhole laser tool includes a laser surface unit connected to a fiber optic cable, a hard case surrounding the fiber optic cable, an outer casing surrounding the hard case, a rotational system positioned within the outer casing, and a rotational head extending from the rotational system. The rotational head includes a focusing system and a downhole laser tool head. The focusing system includes a beam manipulator, a focused lens, and a collimator. The downhole laser tool head includes a first cover lens, a fluid knife, a purging nozzle, a vacuum nozzle, and a temperature sensor. The method includes operating the laser surface unit in a run mode, the run mode concludes when a desired penetration depth is reached by a collimated laser beam. The fiber optic cable connected to laser surface unit conducts a raw laser beam to the focusing system of the rotational head of the rotational system during the run mode. The method further includes emitting the raw laser beam from the fiber optic cable to the beam manipulator. The beam manipulator redirects the path of the raw laser beam toward the focused lens. The method further includes focusing the raw laser beam in the focused lens to create a focused laser beam, collimating the focused laser beam in the collimator to create a collimated laser beam, passing the collimated laser beam through the first cover lens, sweeping the first cover lens with the fluid knife, purging the path of the collimated laser beam with the purging nozzle during the run mode, sublimating the hydrocarbon bearing formation with the collimated laser beam during the run mode to create a tunnel to the desired penetration depth, and vacuuming the dust and vapor with the vacuum nozzle during the run mode.

In certain embodiments, the method further includes rotating the rotational system to target a new area of the hydrocarbon bearing formation.

In certain embodiments, the rotational system includes multiple rotational heads.

In certain embodiments, the run mode includes a cycling mode, cycling the laser surface unit between on periods and off periods, where the raw laser beam is conducted from the laser surface unit to the focusing system during the on period.

In certain embodiments, the method also includes the steps of purging the path of the of the collimated laser beam with the purging nozzle during the on period and vacuuming the dust and vapor with the vacuum nozzle during the off period.

In certain embodiments, the run mode includes a continuous mode, where the laser surface unit operates continuously until desired penetration depth is reached.

BRIEF DESCRIPTION OF THE DRAWINGS

These and other features, aspects, and advantages of the present invention will become better understood with regard to the following descriptions, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

While the invention will be described with several embodiments, it is understood that one of ordinary skill in the relevant art will appreciate that many examples, variations and alterations to the apparatus and methods described herein are within the scope and spirit of the invention. Accordingly, the exemplary embodiments of the invention described herein are set forth without any loss of generality, and without imposing limitations, on the claimed invention.

Figure 1:
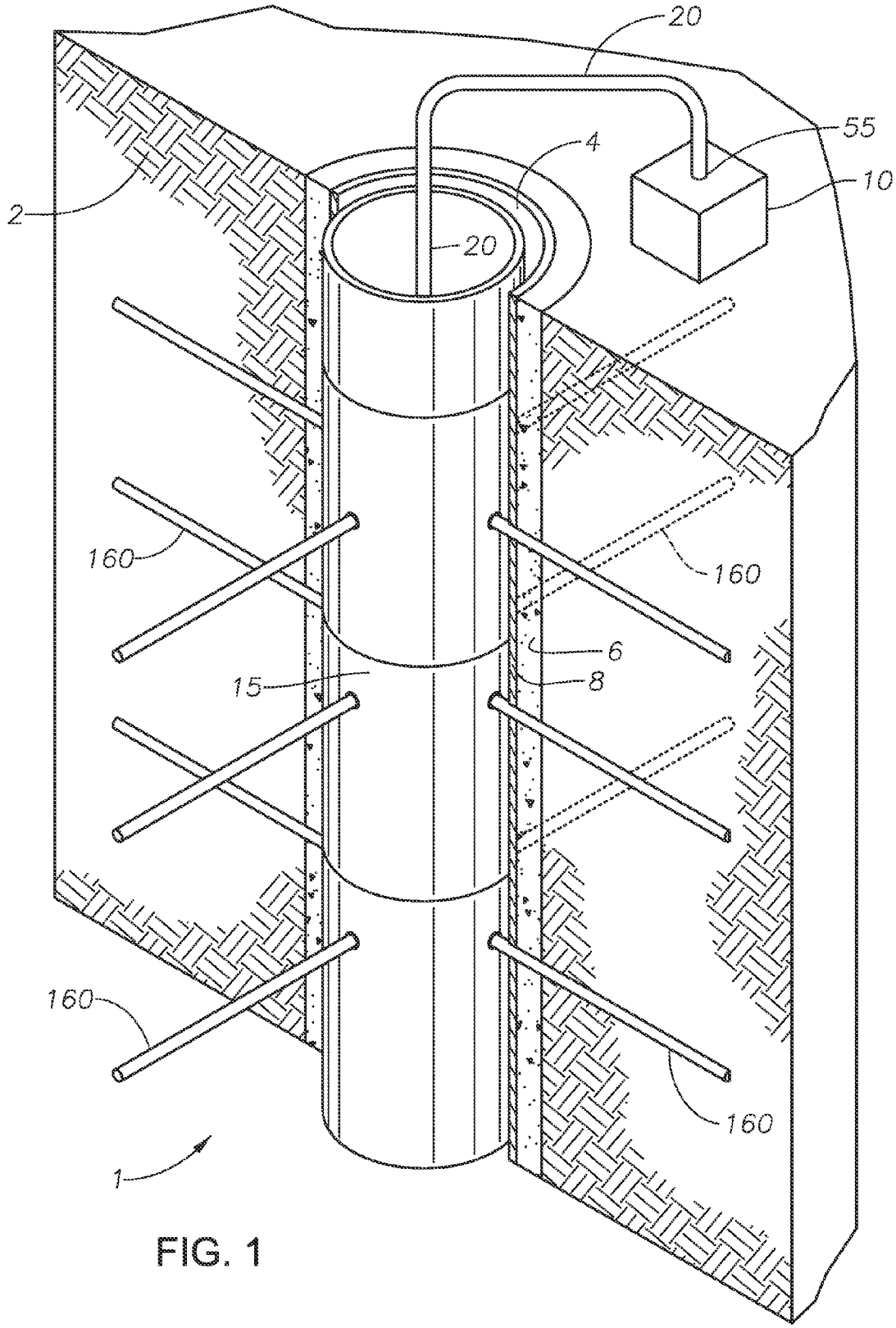
FIG. 1 is a perspective view of an embodiment of the present invention.

FIG. 1 depicts a perspective view of a downhole laser tool in accordance with one embodiment of this invention. Laser surface unit 10 sits on the surface of the earth near existing wellbore 4. Existing wellbore 4 has been dug into hydrocarbon bearing formation 2, with cement 6 and wellbore casing 8 as reinforcement. Downhole laser tool head (not shown) sits within existing wellbore 4. Laser surface unit 10 is in electrical communication with fiber optic cable 20. Laser surface unit 10 is connected to laser surface end 55 of fiber optic cable 20. Laser cable end (not shown) of fiber optic cable 20 is connected to downhole laser tool head (not shown). In certain embodiments, multiple fiber optic cables 20 may connect laser surface unit 10 to downhole laser tool 1.

In general, the construction materials of downhole laser tool 1 can be of any type of material that are resistant to the high temperatures, pressures, and vibrations experienced within existing wellbore 4 and that protect the system from fluids, dust, and debris. One of ordinary skill in the art will be familiar with suitable materials.

Laser surface unit 10 excites energy to a level above the sublimation point of hydrocarbon bearing formation 2 to form a high power laser beam (not shown). The excitation energy of high power laser beams required to sublimate hydrocarbon bearing formation 2 can be determined by one of skill in the art. In accordance with certain embodiments of the present invention, laser surface unit 10 can be tuned to excite energy to different levels as required for different hydrocarbon bearing formations 2. Hydrocarbon bearing formation 2 can include limestone, shale, sandstone, or other rock types common in hydrocarbon bearing formations. Fiber optic cable 20 conducts the high power laser beam through outer casing 15 to a rotational system (not shown) as a raw laser beam (not shown). The raw laser beam passes through the rotational system to create collimated laser beam 160. The rotational system discharges collimated laser beam 160 to penetrate wellbore casing 8, cement 6, and hydrocarbon bearing formation 2 to form, for example, holes or tunnels.

In accordance with an embodiment of the present invention, collimated laser beam 160 can be discharged in any direction of three-dimensional space. As depicted, downhole laser tool 1 is capable of directing collimated laser beam 160 parallel to the surface and at an angle.

Laser surface unit 10 can be any type of laser unit capable of generating high power laser beams, which can be conducted through fiber optic cable 20. Laser surface unit 10 includes, for example, lasers of ytterbium, erbium, neodymium, dysprosium, praseodymium, and thulium ions. In accordance with an embodiment of the present invention, laser surface unit 10 includes, for example, a 5.34-kW Ytterbium-doped multiclad fiber laser. In an alternate embodiment of the invention, laser surface unit 10 is any type of fiber laser capable of delivering a laser at a minimum loss. The wavelength of laser surface unit 10 can be determined by one of skill in the art as necessary to penetrate hydrocarbon bearing formation 2.

In accordance with one embodiment of the present invention, laser surface unit 10 operates in run mode until a desired penetration depth is reached. A run mode can be defined by, for example, a cycling mode or a continuous mode. The duration of a run mode can be based on the type of hydrocarbon bearing formation 2 and the desired penetration depth. Hydrocarbon bearing formation 2 that would require a run mode in cycling mode includes, for example, sandstones with high quartz content, Berea sandstone. Hydrocarbon bearing formation 2 that requires a run mode in continuous mode includes, for example, limestone. Desired penetration depth can be a desired tunnel depth, tunnel length, or tunnel diameter. Alternately, desired penetration depth may include a hole. Desired penetration depth is determined by the application and hydrocarbon bearing formation 2 qualities such as, geological material or rock type of hydrocarbon bearing formation 2, diameter of the tunnel, rock maximum horizontal stress, or the compressive strength of the rock. In accordance with one embodiment of the present invention, downhole laser tool 1 is intended for deep penetration into hydrocarbon bearing formation 2. Deep penetration is meant to encompass any penetration depth beyond six (6) inches into hydrocarbon bearing formation 2, and can include depths of one, two, three or more feet.

According to one embodiment of the present invention, when a run mode constitutes a cycling mode the laser surface unit cycles between on periods and off periods to avoid overheating downhole laser tool 1 and to clear the path of collimated laser beam 160. Cycle in this context means switching back and forth between an on period, when laser surface unit 10 generates a high power laser beam, and an off period, when laser surface unit 10 does not generate a high power laser beam. The duration of an on period can be the same as a duration of the off period, can be longer than the duration of the off period, can be shorter than the duration of the off period, or can be any combination. The duration of each on period and each off period can be determined from the desired penetration depth, by experimentation, or by both. In accordance with an embodiment of the present invention, laser surface unit 10 is programmable, such that a computer program operates to cycle the laser. Other factors that contribute to the duration of on periods and off periods include, for example, rock type, purging methods, beam diameter, and laser power. In accordance with one embodiment of the present invention, experiments on a representative of the rock type of hydrocarbon bearing formation 2 could be conducted prior to lowering downhole laser tool 1 into existing wellbore 4 of hydrocarbon bearing formation 2. Such experiments could be conducted to determine the optimal duration of each on period and each off period. In accordance with one embodiment of the present invention, on periods and off periods can last one to five seconds. In one embodiment of the invention, a laser beam penetrates hydrocarbon bearing formation 2 of Berea sandstone, in which an on period lasts for four (4) seconds and an off period lasted for four (4) seconds and the penetration depth was twelve (12) inches.

In an alternate embodiment of the present invention, a run mode is a continuous mode. In continuous mode, laser surface unit 10 stays in an on period until the desired penetration depth is reached. In accordance with at least one embodiment of the present invention, the duration of the run mode is defined by the duration of the continuous mode. Laser surface unit 10 is of a type that is expected to operate for many hours before needing maintenance. The particular rock type of hydrocarbon bearing formation 2 can be determined by experiment, by geological methods, or by analyzing samples taken from the hydrocarbon bearing formation 2.

Figure 2:
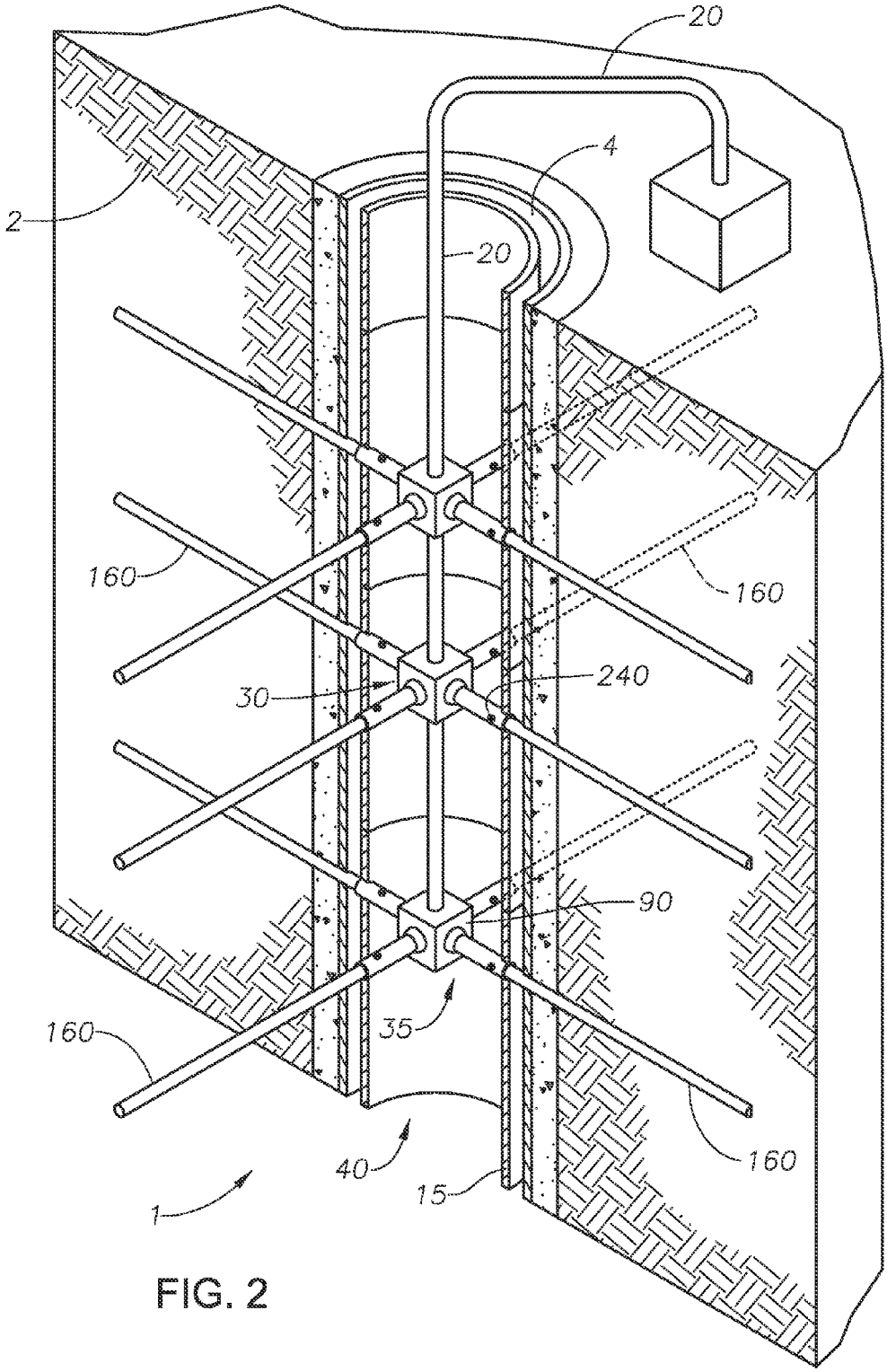
FIG. 2 is a sectional view of an embodiment of the present invention.

FIG. 2 depicts a sectional view of an embodiment of the present invention. In addition to the features described above with reference to FIG. 1, outer casing 15 surrounds downhole laser tool 1 in existing wellbore 4. Outer casing 15 can be any type of material that is resistant to the high temperatures, pressures, and vibrations experienced within existing wellbore 4, but allows for penetration by collimated laser beam 160. In accordance with one embodiment of the present invention, downhole laser tool 1 includes motion system 40, Motion system 40 is lowered to a desired elevation within existing wellbore 4. Motion system 40 is in electrical communication with laser surface unit 10, such that motion system 40 can relay its elevation within existing wellbore 4 to laser surface unit 10 and can receive an elevation target from laser surface unit 10. Motion system 40 can move up or down to the desired elevation. Motion system 40 can include, for example, a hydraulic system, an electrical system, or a motor operated system to drive motion system 40 into place. The controls for motion system 40 are contained as part of laser surface unit 10. Rotational system 30 is attached to motion system 40. Rotational system 30 is in electrical communication with laser surface unit 10, such that rotational system 30 can receive a position target from laser surface unit 10 and provide position information to laser surface unit 10. Rotational system 30 can include, for example, a hydraulic system, an electrical system, or a motor operated system to rotate rotational system 30. In accordance with at least one embodiment of the present invention, laser surface unit 10 can be programmed to control the placement of motion system 40 and rotational system 30 based only on a specified elevation target and a position target. In accordance with an embodiment of the present invention, motion system 40 receives an elevation target from laser surface unit 10 and moves to the elevation target. Either before, during, or after motion system 40 reaches the elevation target, rotational system 30 receives a position target from laser surface unit 10. Rotational system 30 then rotates to align with the position target. Once aligned with the position target, rotational system 30 can lock into place for operation of the laser. In an alternate embodiment of the present invention, rotational system 30 can rotate while the laser is in operation. In accordance with one embodiment of the present invention, rotational system 30 can rotate in 360 degrees.

Rotational system 30 includes rotational head 35 and rotational casing 90. According to some embodiments, downhole laser tool 1 can include more than one rotational system 30. The need for additional rotational system 30 can be determined by the depth of existing wellbore 4. According to some embodiments, rotational system 30 may contain one, two, three, four or more rotational heads 35. Each rotational head 35 contains at least one temperature sensor 240. Temperature sensor 240 provides temperature data to laser surface unit 10, as a way to monitor one physical property at rotation head 35. In accordance with one embodiment of the present invention, downhole laser tool 1 can be configured to shut off the laser when the temperature as monitored by temperature sensor 240 exceeds a pre-set point. The pre-set point can be set to avoid the overheating point of downhole laser tool 1. The overheating point can be based on the type of laser and the configuration of downhole laser tool 1, in addition to other parameters that may be critical to determine the overheating point. Avoiding overheating prevents damage to downhole laser tool 1.

In accordance with an embodiment of the present invention, multiple fiber optic cables 20 can conduct multiple high power laser beams (not shown) to multiple rotational systems 30 simultaneously. The need for multiple rotational systems 30 can be determined by the application.

Figure 3:
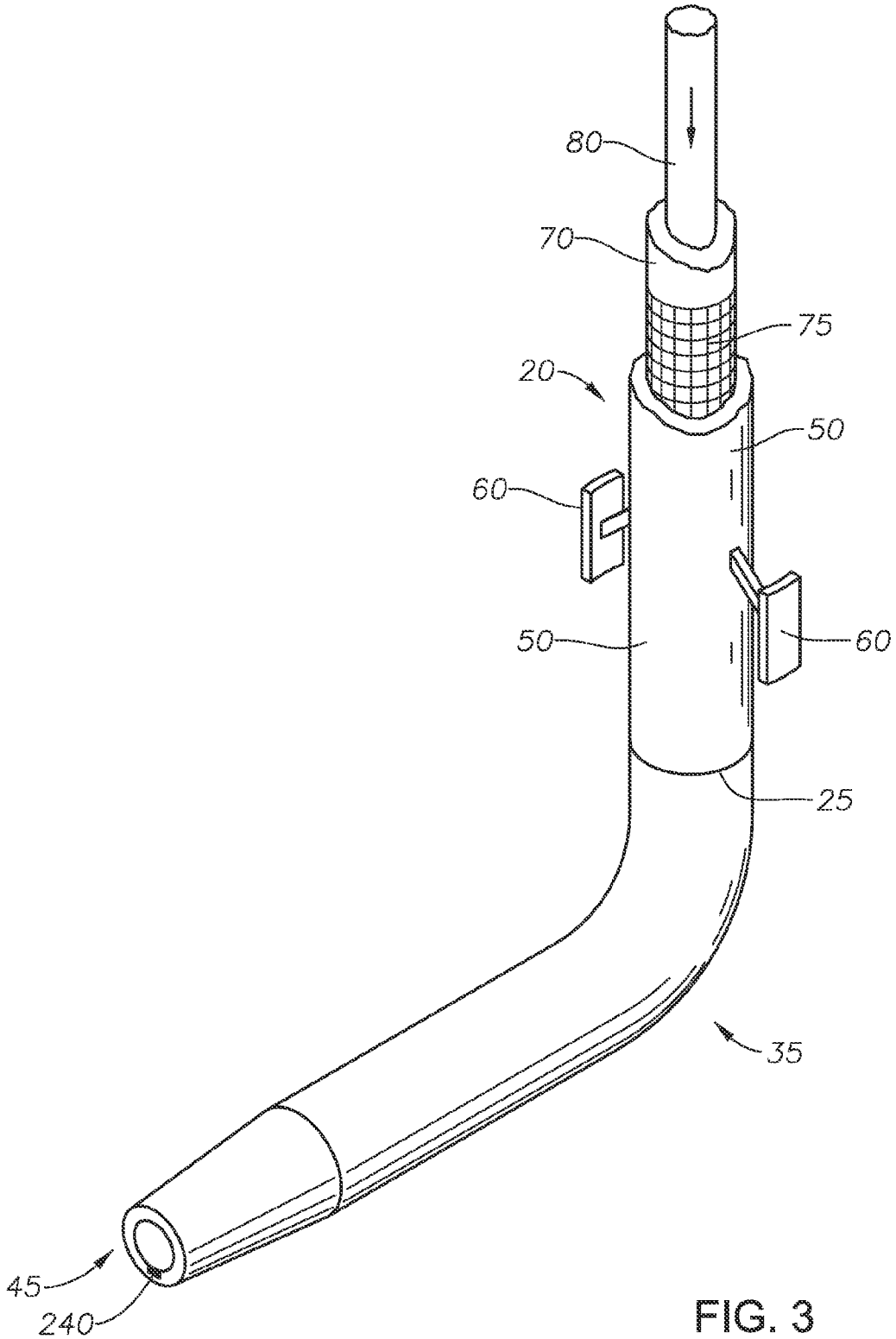
FIG. 3 is a perspective view of an embodiment of the rotational head and an exploded view of the fiber optic cable.

FIG. 3 contains a perspective view of rotational head 35. Fiber optic cable 20, according to an embodiment of the invention, includes hard case 50, insulation cable 70, and protective laser fiber cable 75. Fiber optic cable 20 conducts raw laser beam 80. Hard case 50 can be of any material which is resistant to the high temperatures, high pressures, and vibrations experienced within existing wellbore 4. Insulation cable 70 can be any type of material that protects fiber optic cable 20 from overheating due to the temperature of existing wellbore 4 and the temperature of raw laser beam 80, as raw laser beam 80 travels from laser surface unit 10 to laser muzzle 45. Protective laser fiber cable 75 can be any type of material that protects fiber optic cable from being scratched, bending, breaking, or other physical damages which could be experienced in existing wellbore 4. Protective laser fiber cable 75 can include, for example, reinforced flexible metals, such that the reinforced flexible metals bend as fiber optic cable 20 bends or twists. Protective laser fiber cable 75 can be embedded within insulation cable 70 (as shown) or can be attached to the inner surface of insulation cable 70 (not shown).

Laser cable end 25 can be connected to rotational head 35. In alternate embodiments, laser cable end 25 can be connected to the rotational casing (not shown). The connection between laser cable end 25 and rotational head 35 can be flexible, allowing for the movement and rotation of rotational head 35 in three-dimensional space. In alternate embodiments, rotational system 30 rotates around the axis of hard case 50. Rotational system 30 rotates as described with reference to FIG. 2. Stabilizing pads 60 attached to hard case 50 are provided to stabilize fiber optic cable 20 within outer casing 15 (not shown). Fiber optic cable 20 can be centrally positioned within outer casing 15 or can be off-center as required. Stabilizing pads 60 can be any type of pads, anchors, or positioners capable of anchoring fiber optic cable 20 in place within outer casing 15. Stabilizing pads 60 can be any type of material which is resistant to the high temperatures, high pressures, and vibrations experienced within existing wellbore 4. Stabilizing pads 60 can be placed at any point on fiber optic cable 20 where anchoring or stabilizing reinforcement is needed. In accordance with some embodiments of the present invention, multiple stabilizing pads 60 can be used on fiber optic cable 20.

Rotational head 35 includes laser muzzle 45 through which collimated laser beam 160 (not shown) is discharged. Rotational head 35 can taper such that the diameter of laser muzzle 45 is smaller than the diameter of the main body of rotational head 35. The ratio of diameters can be determined by one of skill in the art. Laser muzzle 45 need only be large enough to provide an unobstructed path for the discharge of collimated laser beam 160 (not shown). The tapering of rotational head 35 prevents dust and vapor from entering rotational head 35 through laser muzzle 45. Vapor may include dust and other particulate matter.

Laser muzzle 45 includes temperature sensor 240. In accordance with an embodiment of the present invention, laser muzzle 45 includes two temperature sensors 240. One of skill in the art will appreciate that laser muzzle 45 can include, for example, one, two, or more temperature sensors 240 as required for monitoring. Temperature sensor 240 monitors the temperature of laser muzzle 45. The data collected by temperature sensor 240 can be used to protect downhole laser tool 1 from overheating or can monitor the intensity of collimated laser beam 160 (not shown) to allow for adjustments.

Rotational head 35 can be any material which is resistant to the high temperatures, high pressures, and vibrations experienced within existing wellbore 4.

Figure 4A:
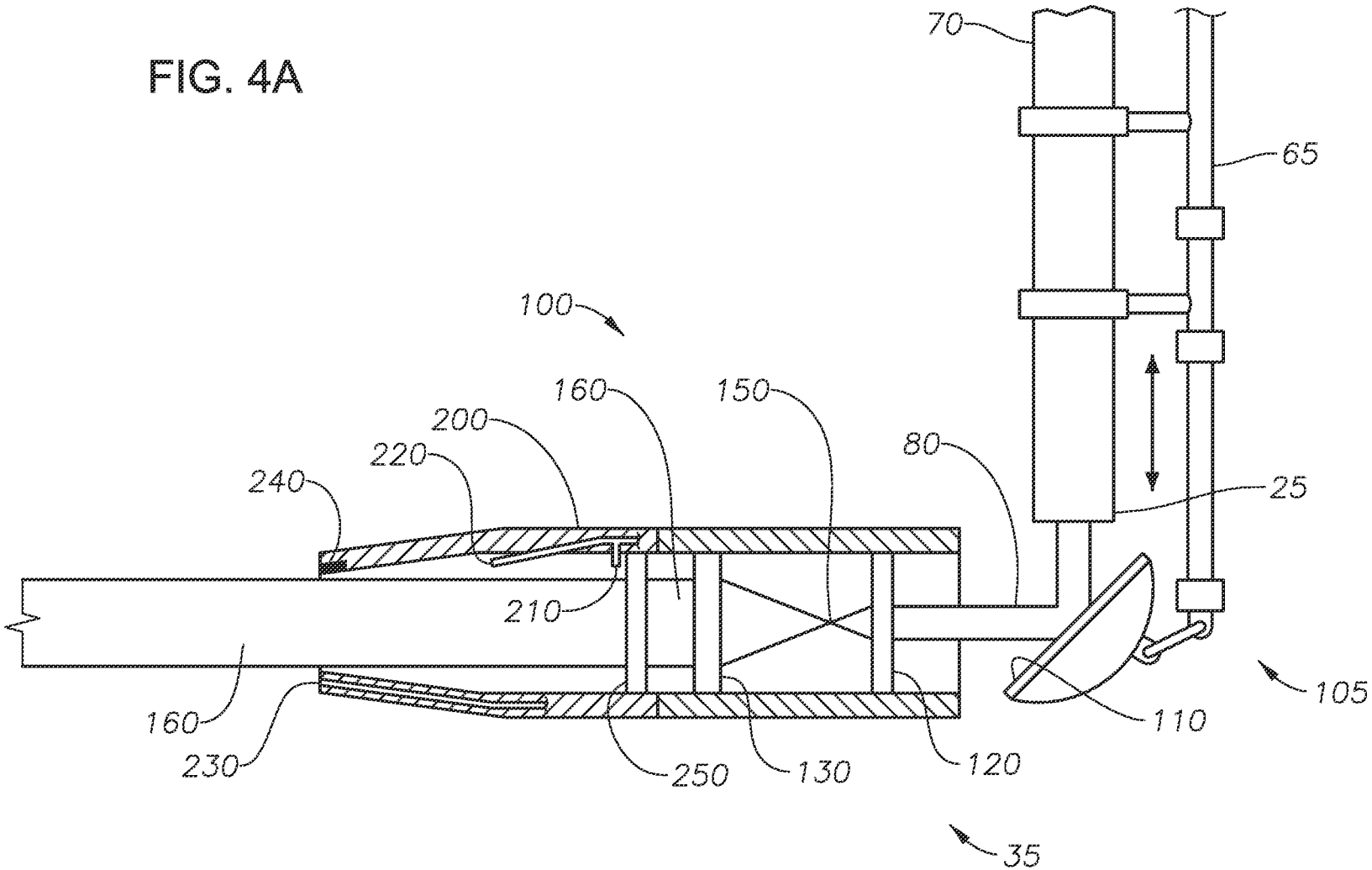
FIG. 4A is a sectional view of an embodiment of the rotational head.

FIG. 4A is a sectional view of an embodiment of rotational head 35. Insulation cable 70 is held in place by cable support 65 within hard case 50 (not shown). Insulation cable 70 discharges raw laser beam 80. In accordance with an embodiment of the present invention, focusing system 100 can be contained within rotational head 35.

Focusing system 100 includes generally a set of lenses that shape raw laser beam 80. The lens of focusing system 100 can be any type of optical lenses that do not require cooling. The physical distance between the lenses affects the size and shape of the tunnel created by downhole laser tool 1 in hydrocarbon bearing formation 2. Focusing system 100 can include, for example, beam manipulator 105, focused lens 120 and collimator 130. Focusing system 100 can include additional lenses as needed for the particular application (not shown).

Beam manipulator 105 is connected to cable support 65 proximate to laser cable end 25. In some embodiments of the present invention, the position of beam manipulator 105 is set before operation of laser surface unit 10. In some embodiments, the position of beam manipulator 105 can be adjusted during an off period of laser surface unit 10. In an alternate embodiment, beam manipulator 105 can be adjusted during an on period of laser surface unit 10. Beam manipulator 105 directs the direction and angle in three-dimensional space of raw laser beam. The angle and direction can be adjusted based on the desired location, angle of entry, and geometry for penetrating hydrocarbon bearing formation 2 (not shown). In accordance with one embodiment of the invention, beam manipulator 105 redirects the path of raw laser beam 80. Beam manipulator 105 redirects the path of raw laser beam 80 along a different angle, along the x-axis, the y-axis, or both. Beam manipulator 105 can be positioned before discharge of raw laser beam 80 or during discharge of raw laser beam 80. Beam manipulator 105 includes, for example, reflector mirror 110.

Raw laser beam 80 can exit laser cable end 25 as a beam of any size. The size of raw laser beam 80 depends upon the size of fiber optic cable 20 and can be chosen by one of skill in the art based on factors that include, for example, rock type, desired penetration depth, desired tunnel size, power of laser surface unit 10. In accordance with an embodiment of the present invention, raw laser beam 80 exits laser cable end 25 into focusing system 100 as a 1" beam. Beam manipulator 105 directs raw laser beam 80 through focusing system 100.

Focused lens 120 can be positioned proximate to beam manipulator 105. Focused lens 120 can be fixed inside rotational head 35. Focused lens 120 can be any type of lens that can focus raw laser beam 80 to create focused laser beam 150. Focused lens 120 can be any material, for example, glass, plastic, quartz, crystal or other material capable of focusing a laser beam. The shape and curvature of focused lens 120 can be determined by one of skill in the art based on the application of downhole laser tool 1. Focused lens 120 controls the divergence of raw laser beam 80, which controls the shape of the tunnel or hole. For example, the tunnel can be conical, spherical, or ellipsoidal.

Focused laser beam 150 enters collimator 130 which collimates focused laser beam 150 to create collimated laser beam 160. Collimator 130 can be positioned proximate to focused lens 120. Collimator 130 can be fixed inside rotational head 35. Collimator 130 can be any material, for example, glass, plastic, quartz, crystal or other material capable of collimating a laser beam. The shape and curvature of collimator 130 can be determined by one of skill in the art based on the application of downhole laser tool 1. A collimator is capable of aligning light waves or can also make a laser beam a smaller diameter. Collimator 130 creates collimated laser beam 160 which has a fixed diameter resulting in a straight tunnel or hole. Controlling the diameter of collimated laser beam 160 controls the diameter of the tunnel.

Collimated laser beam 160 enters downhole laser tool head 200. Downhole laser tool head 200 includes cover lens 250, fluid knife 210, purging nozzles 220, vacuum nozzles 230 and temperature sensor 240. Collimated laser beam 160 passes through cover lens 250. Cover lens 250 protects focusing system 100 by preventing dust and vapor from entering focusing system 100. In accordance with certain embodiments of the present invention, downhole laser tool head 200 can include more than one cover lens. Downhole laser tool head 200 can include, for example, one, two, three, or more cover lenses depending on the need for additional layers of protection from dust, vapors, or other environmental conditions. Cover lens 250 does not manipulate collimated laser beam 160. Fluid knife 210 sweeps dust and vapor from cover lens 250. Fluid knife 210 is proximate to cover lens 250. Sweeping cover lens 250 provides collimated laser beam 160 an obstructed path from focusing system 100 to laser muzzle 45. Fluid knife 210 emits any gas, including, for example, air or nitrogen capable of keeping cover lens 250 clear of dust and vapor. Cover lens 250 can be any material, for example, glass, plastic, quartz, crystal or other material capable of protecting focusing system 100 without manipulating collimated laser beam 160. The shape and curvature of cover lens 250 can be determined by one of skill in the art based on the application of downhole laser tool 1.

Purging nozzles 220 clear the path of collimated laser beam 160 from cover lens 250 to hydrocarbon bearing formation 2. Those of skill in the art will appreciate that in certain embodiments it is the combined function of fluid knife 210 and purging nozzles 220 that create an unobstructed path for collimated laser beam 160 from cover lens 250 to hydrocarbon bearing formation 2. One of skill in the art will appreciate that purging nozzles 220 could be one, two or more nozzles capable of purging the area in front of laser muzzle 45. Purging nozzles 220 emit any purging media capable of clearing dust and vapor from laser muzzle 45 and the front of rotational head 35. Purging media can include, for example, liquid or gas. The choice of purging media, between liquid or gas, can be based on the rock type of hydrocarbon bearing formation 2 and the reservoir pressure. Purging media that allow collimated laser beam 160 to reach hydrocarbon bearing formation 2 with minimal or no loss can also be considered. According to one embodiment of the present invention, purging media would be a non-reactive, non-damaging gas such as nitrogen. A gas purging media can also be appropriate when there is a low reservoir pressure. Purging nozzles 220 lie flush inside rotational head 35 between fluid knife 210 and laser muzzle 45 so as not to obstruct the path of collimated laser beam 160.

In accordance with an embodiment of the present invention, purging nozzles 220 purge rotational head 35 in cycles of on periods and off periods. An on period occurs while collimated laser beam 160 is discharging as controlled by an on period of laser surface unit 10, as described above with reference to FIG. 1. In an alternate embodiment of the present invention, purging nozzles 220 operate in a continuous mode.

Vacuum nozzles 230 vacuum dust and vapor, created by the sublimation of hydrocarbon bearing formation 2 by collimated laser beam 160, from the area surrounding laser muzzle 45. The dust and vapor are removed to the surface and analyzed. Analysis of the dust and vapor can include determination of, for example, rock type of hydrocarbon bearing formation 2 and fluid type contained within hydrocarbon bearing formation 2. In an alternate embodiment of the present invention, the dust and vapor can be disposed once at the surface. Vacuum nozzles 230 can be positioned flush with laser muzzle 45. One of skill in the art will appreciate that vacuum nozzles 230 can include one, two, three, four, or more nozzles depending on the quantity of dust and vapor. The size of vacuum nozzles 230 depends on the volume of dust and vapor to be removed and the physical requirements of the system to transport from downhole laser tool head 200 to the surface.

In accordance with one embodiment of the present invention, vacuum nozzles 230 operate in cycles of on periods and off periods. On periods occur while collimated laser beam 160 and purging nozzles 220 are not operating, as controlled by laser surface unit 10. The off periods of collimated laser beam 160 and purging nozzles 220 allow the vacuum nozzles 230 to clear a path, so collimated laser beam 160 has an unobstructed path from cover lens 250 to hydrocarbon bearing formation 2. In an alternate embodiment of the present invention, vacuum nozzles 230 operate in a continuous mode. In another alternate embodiment of the present invention, vacuum nozzles 230 would not operate when purging nozzles 220 emit a liquid purging media.

One of skill in the art will appreciate that fluid knife 210, purging nozzles 220, and vacuum nozzles 230 operate in conjunction to eliminate dust and vapor in the path of collimated laser beam 160 clear from cover lens 250 to the penetration point in hydrocarbon bearing formation 2. Those skilled in the art will appreciate the need to eliminate dust in the path of collimated laser beam 160 due to the potential to disrupt, bend, or scatter collimated laser beam 160.

Figure 4B:
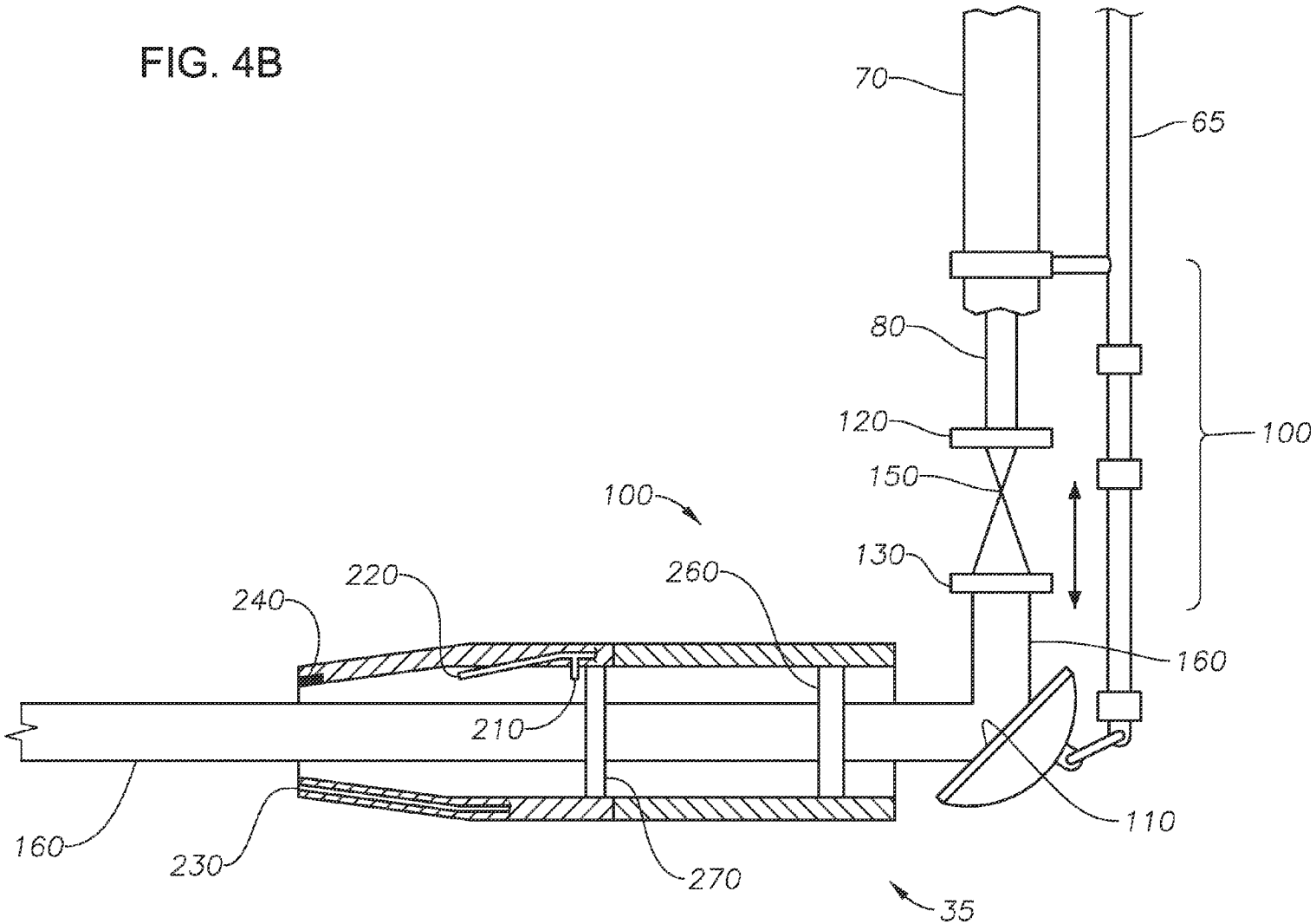
FIG. 4B is a sectional view of an alternate embodiment of the rotational head.

FIG. 4B is a sectional view of an alternate embodiment of rotational head 35. With reference to previous FIGS., focusing system 100 can be within rotational casing 90 (not shown). In accordance with one embodiment of the present invention, raw laser beam 80 exits insulation cable 70 and first enters focused lens 120 to create focused laser beam 150. Focused laser beam 150 then enters collimator 130 to create collimated laser beam 160. The features of focused lens 120 and collimator 130 are described with reference to FIG. 4A.

In accordance with an embodiment of the present invention, reflector mirror 110 directs collimated laser beam 160 into rotational head 35 through first cover lens 260. In accordance with certain embodiments, rotational head 35 can include more than one cover lens. Rotational head 35 can include, for example, one, two, three, or more cover lenses can be provided depending on the need for additional layers of protection from dust, vapor, or other environmental conditions. In an alternate embodiment of the present invention, rotational head 35 contains two cover lens, first cover lens 260 and second cover lens 270. First cover lens 260 and second cover lens 270 may be described with reference to cover lens 250 as described above.

One of skill in the art will appreciate that the position of beam manipulator 105 with respect to focus lens 120 and collimator lens 130 does not affect the characteristics of collimated laser beam 160. Placement of elements of the focusing system 100 can be determined by the needs of the application, the need for additional reinforcement in the lenses, the spatial needs of the rotational system as dictated by existing wellbore 4, or the type of beam manipulator employed.

Figure 4C:
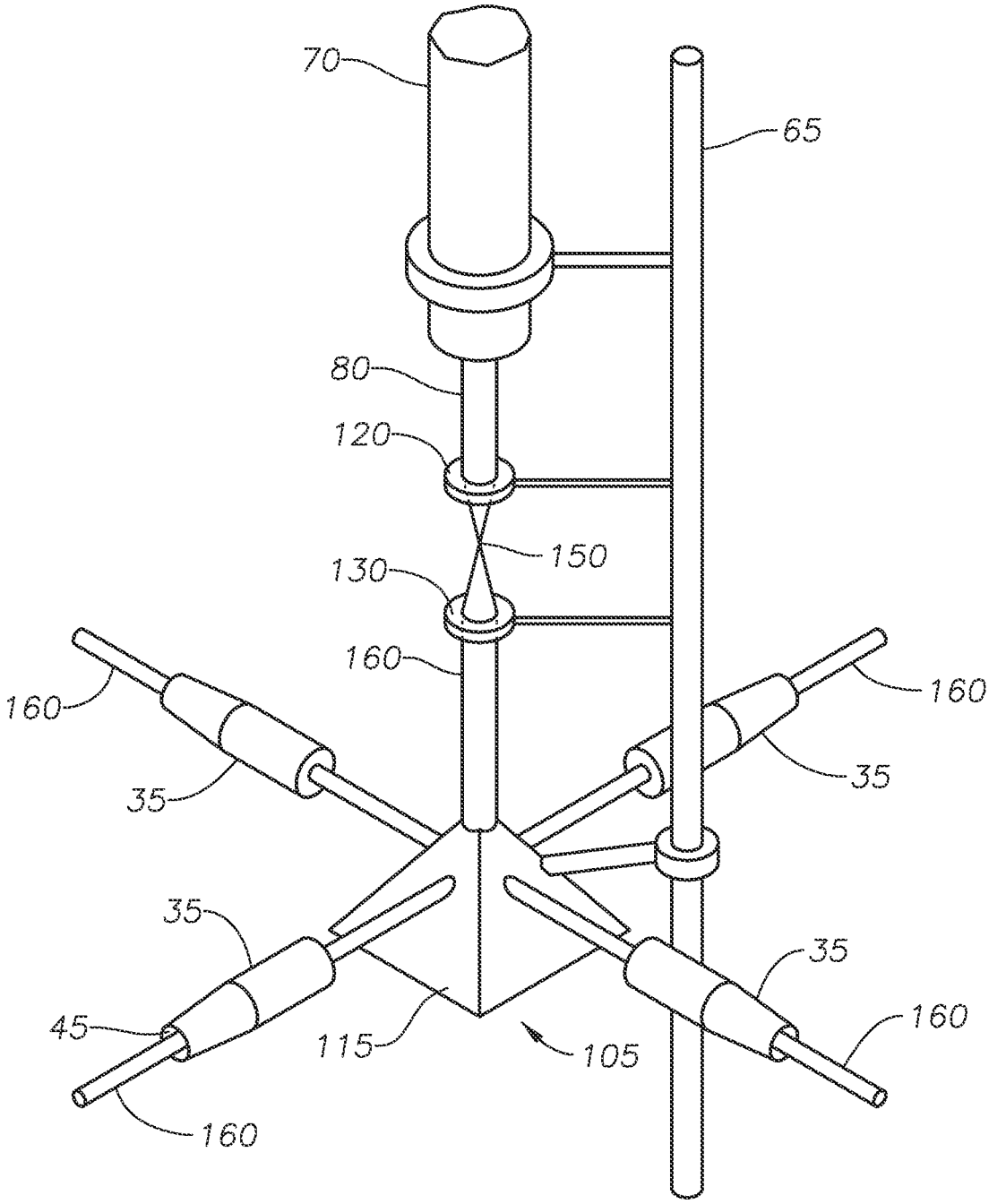
FIG. 4C is a sectional view of an alternate embodiment of the rotational head.

With reference to previous figures, FIG. 4C depicts an alternate embodiment of the present invention. In accordance with one embodiment of the present invention, beam manipulator 105 can include, for example, beam splitter 115. Beam splitter 115 can include any device capable of splitting a single laser beam into multiple laser beams. Beam splitter 115 can include, for example, a prism. Beam splitter 115 can be selected to split a single laser beam into two, three, four, or more laser beams depending on the requirements of the application. Beam splitter 115 can also change the direction and angle in three-dimensional space of collimated laser beam 160.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

The singular forms "a," "an," and "the" include plural referents, unless the context clearly dictates otherwise.

Optional or optionally means that the subsequently described event or circumstances can or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these references contradict the statements made herein.

As used herein and in the appended claims, the words "comprise," "has," and "include" and all grammatical variations thereof are each intended to have an open, non-limiting meaning that does not exclude additional elements or steps.

As used herein, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present invention.

What is claimed is:

1. A downhole laser tool for penetrating a hydrocarbon bearing formation, the downhole laser tool comprising:

a laser surface unit configured to generate a high power laser beam, the laser surface unit in electrical communication with a fiber optic cable, the fiber optic cable configured to conduct the high power laser beam, the fiber optic cable comprising an insulation cable configured to resist high temperature and high pressure, a protective laser fiber cable configured to conduct the high power laser beam, a laser surface end configured to receive the high power laser beam, a laser cable end configured to emit a raw laser beam from the fiber optic cable;

an outer casing placed within an existing wellbore wherein the existing wellbore extends within a hydrocarbon bearing formation;

a hard case placed within the outer casing, wherein the fiber optic cable is contained within the hard case; and a rotational system positioned within the outer casing, the rotational system comprising a rotational casing coupled to the end of the hard case, a rotational head extending from the rotational casing, wherein the rotational system is configured to rotate around the axis of the hard case, wherein the rotational head comprises a focusing system configured to direct the raw laser beam, and a downhole laser tool head configured to discharge a collimated laser beam into the hydrocarbon bearing formation;

wherein the focusing system comprises a beam manipulator configured to direct the raw laser beam, a focused lens configured to create a focused laser beam, and a collimator configured to create the collimated laser beam, wherein the beam manipulator is positioned proximate to the laser cable end of the fiber optic cable, the focused lens is positioned to receive the raw laser beam, the collimator is positioned to receive the focused laser beam; and wherein the downhole laser tool head comprises a first cover lens proximate to the focusing system, a laser muzzle positioned to discharge the collimated laser beam from the downhole laser tool head, a fluid knife proximate to the laser muzzle side of the first cover lens, a purging nozzle within the downhole laser tool proximate to the laser muzzle, a vacuum nozzle proximate with the laser muzzle, and a temperature sensor adjacent to the laser muzzle, wherein the first cover lens is configured to protect the focusing system, the fluid knife is configured to sweep the first cover lens, the purging nozzle is configured to remove dust from the path of the collimated laser beam, the vacuum nozzle is configured to collect dust and vapor from the path of the collimated laser beam.

2. The downhole laser tool of claim 1, further comprising stabilizing pads attached to the hard case and configured to hold the hard case in place relative to the outer casing.

3. The downhole laser tool of claim 1, wherein the beam manipulator is a reflector mirror.

4. The downhole laser tool of claim 1, wherein the beam manipulator is a beam splitter.

5. The downhole laser tool of claim 1 further comprising a second cover lens positioned proximate to the first cover lens between the first cover lens and the fluid knife.

6. The downhole laser tool of claim 1, wherein the focused lens is positioned proximate to the laser cable end of the fiber optic cable, the collimator is positioned to receive the focused laser beam, the beam manipulator is positioned to receive the collimated laser beam.

7. The downhole laser tool of claim 1 further comprising multiple rotational heads extending from one rotational casing.

8. The downhole laser tool of claim 1 further comprising multiple rotational systems.

9. The downhole laser tool of claim 1, wherein the downhole laser tool head has a tapered laser muzzle.

10. The method for penetrating a hydrocarbon bearing formation with a downhole laser tool, the method comprising the steps of:

extending a downhole laser tool into an existing wellbore, the downhole laser tool comprising a laser surface unit connected to a fiber optic cable, a hard case surrounding the fiber optic cable, an outer casing surrounding the hard case, a rotational system positioned within the outer casing, and a rotational head extending from the rotational system, wherein the rotational head comprises a focusing system and a downhole laser tool head, wherein the focusing system comprises a beam manipulator, a focused lens, and a collimator, wherein the downhole laser tool head comprises a first cover lens, a fluid knife, a purging nozzle, a vacuum nozzle, and a temperature sensor;

operating the laser surface unit in a run mode, wherein the fiber optic cable connected to laser surface unit conducts a raw laser beam to the focusing system of the rotational head of the rotational system during the run mode, wherein the run mode concludes when a desired penetration depth is reached by a collimated laser beam;

emitting the raw laser beam from the fiber optic cable to the beam manipulator, wherein the beam manipulator redirects the path of the raw laser beam toward the focused lens;

focusing the raw laser beam in the focused lens to create a focused laser beam;

collimating the focused laser beam in the collimator to create a collimated laser beam;

passing the collimated laser beam through the first cover lens;

sweeping the first cover lens with the fluid knife;

purging the path of the collimated laser beam with the purging nozzle during the run mode of the laser surface unit;

sublimating the hydrocarbon bearing formation with the collimated laser beam during the run mode of the laser surface unit to create a tunnel to the desired penetration depth; and vacuuming the dust and vapor with the vacuum nozzle during the run mode of the laser surface unit.

11. The method of claim 10, further comprising the step of:

rotating the rotational system to target a new area of the hydrocarbon bearing formation.

12. The method of claim 10, wherein the rotational system comprises multiple rotational heads.

13. The method of claim 10, wherein the run mode comprises a cycling mode, wherein the cycling mode further comprises the step of cycling the laser surface unit between on periods and off periods, wherein the raw laser beam is conducted from the laser surface unit to the focusing system during the on period.

14. The method of claim 13, further comprising the steps of purging the path of the collimated laser beam with the purging nozzle during the on period; and vacuuming the dust and vapor with the vacuum nozzle during the off period.

15. The method of claim 10, wherein the run mode comprises a continuous mode, wherein the laser surface unit operates continuously until desired penetration depth is reached.

* * * * *